US005325905A

United States Patent [19]

Sourlier

[11] Patent Number: 5,325,905

[45] Date of Patent: Jul. 5, 1994

[54] METHOD AND APPARATUS FOR MULTI-STAGE, LOW-PRESSURE METAL CASTING

[75] Inventor: Pascal Sourlier, Maxeville, France

[73] Assignee: Pont-A-Mousson S.A., Nancy, France

[21] Appl. No.: 97,599

[22] Filed: Jul. 27, 1993

Related U.S. Application Data

[63] Continuation of Ser. No. 984,728, Dec. 4, 1992, abandoned, which is a continuation of Ser. No. 718,704, Jun. 21, 1991, abandoned.

[30] Foreign Application Priority Data

Jun. 22, 1990 [FR] France ..... 9007860

[51] Int. Cl.[5] ..... B22D 17/06

[52] U.S. Cl. ..... 164/119; 164/306

[58] Field of Search ..... 164/119, 306, 133, 362, 164/255, 63

[56] References Cited

U.S. PATENT DOCUMENTS 2,940,142 6/1960 Wells et al. .
3,628,598 12/1971 MacNeil et al. .
3,656,539 4/1972 Zickefoose .
4,008,749 2/1977 Bellocci et al. ..... 164/119
4,112,997 9/1978 Chandley ..... 164/119
4,133,370 1/1979 Bellocci et al. .
4,143,687 3/1979 Bellocci .

FOREIGN PATENT DOCUMENTS 2295808 12/1974 France .
2367566 10/1976 France .
2556996 12/1983 France .

*Primary Examiner*—Kuang Y. Lin
*Attorney, Agent, or Firm*—Sughrue, Mion, Zinn, Macpeak & Seas

[57] ABSTRACT

A multi-stage sand mold 4 defines a plurality of casting impressions or cavities 31 fed with molten metal from a tubular central chamber 28 via intermediate ducts 30A, 30B extending horizontally outwardly from opposite sides of the chamber, and ingates 32A, 32B extending between the ducts and the impressions. At each stage the sum of the cross-sectional areas of the ducts at their inlets is substantially less than the cross-sectional area of the central chamber, and the sum of the cross-sectional areas of the ingates fed by a given duct is at least equal to its cross-sectional area. This results in delivery rate reductions at the entrances to the ducts and in pressure reductions at the entrances to the ingates, which enhances the uniformity and integrity of the castings.

8 Claims, 2 Drawing Sheets

METHOD AND APPARATUS FOR MULTI-STAGE, LOW-PRESSURE METAL CASTING

This is a continuation application of pending prior parent application Ser. No. 07/984,728 filed on Dec. 4, 1992 which is a continuation application of pending prior application Ser. No. 07/718,704 filed on Jun. 21, 1991 and both now abandoned.

BACKGROUND OF THE INVENTION

This invention concerns low-pressure metal casting in a multistage recessed sand mold. It further concerns a method and apparatus for feeding the mold impressions with low-pressure casting metal, wherein the feed occurs through a casting chamber, and at each stage at least one intermediate duct begins at the chamber and leads to ingates which connect the duct to the or each impression.

A low-pressure casting method (see, for example, commonly assigned French Patent Nos. 2,295,808; 2,367,566; and 2,556,996) is particularly advantageous, when compared with gravitational casting, for the production of thin-walled metal parts and/or parts having complex shapes and/or parts of large size. In fact, the pressure exerted by the metal, which results from the injection of a gas inside a water-tight cavity containing the molten metal, may be closely and accurately controlled to push the metal into all of the innermost recesses of the impressions.

In conventional techniques, at each stage of the mold, a single, large cross-sectional intermediate duct, or two such ducts positioned diametrically opposite each other, connect the casting chamber to an entire set of ingates belonging to the stage. This method exhibits the following disadvantages linked to the large cross-section of the duct(s):

(1) Strong turbulence is created in the metal flow, thereby promoting erosion of the sand and the occlusion of air bubbles, to the detriment of the integrity of the parts obtained.

(2) It is not possible to cause the metal to rise rapidly to the top of the casting chamber, and filling actually occurs stage by stage, a phenomenon which makes it impossible to profit from all of the advantages of low-pressure casting.

(3) When the pressure is lowered and after the solidification of the ingates, which thus form obturators (see the aforementioned French Patent No. 2,295,808), the metal contained in the intermediate duct, which constitutes a relatively large volume that has cooled appreciably, returns to the casting cavity. During the following casting operation, the cooler metal is the first to rise into the casting chamber, thus adversely affecting the quality of some molded parts. For the same reason, an excessive metal flow is required during each casting.

SUMMARY OF THE INVENTION

An object of the invention is to overcome these problems. To this end, the method according to the invention is characterized by the liquid metal feed being narrowed off at each stage, at the inlet to the intermediate ducts.

According to other features:

a) the pressure of the liquid metal is decreased after it is fed into the intermediate ducts, especially when it enters the ingates, b) a liquid metal flow, adapted to cause the metal to rise above all of the intermediate ducts, is sent through the feed tube, and c) the feed pressure of the mold is kept constant until the solidification of all of the intermediate ducts, and then the pressure is decreased.

A further object of the invention is to provide a recessed sand mold designed to implement the above method. The mold, which comprises a casting chamber and at least two stages, each of which is fitted with an impression fed by ingates connected to the casting chamber by at least one intermediate duct, is characterized by the sum of the areas of the inlet sections of the intermediate ducts belonging to each stage being significantly less than the area of the section of the casting chamber.

According to other features:

a) the sum of the areas of the ingate sections fed by a single duct is at least equal to the area of the inlet section of the duct, b) each impression is fed by at least two intermediate ducts extending on either side of the casting chamber, and c) the sum of the areas of the entry section of the intermediate ducts belonging to each stage is less than 10% of the area of the section of the casting chamber.

Yet another object of the invention is to provide a low-pressure metal casting installation having a recessed multi-stage sand mold which comprises a casting cavity from which a feed tube opening extends upwardly, a pressurized gas source connected to the cavity, at least one recessed sand mold comprising a casting chamber opening downwardly and having at least two stages, each of which is fitted with at least one impression fed through ingates connected to the casting chamber by means of at least one intermediate duct, and means for securing the base of the casting chamber onto the opening of the feed tube.

DETAILED DESCRIPTION OF THE PREFERRED EMBODIMENT

Figure 1:
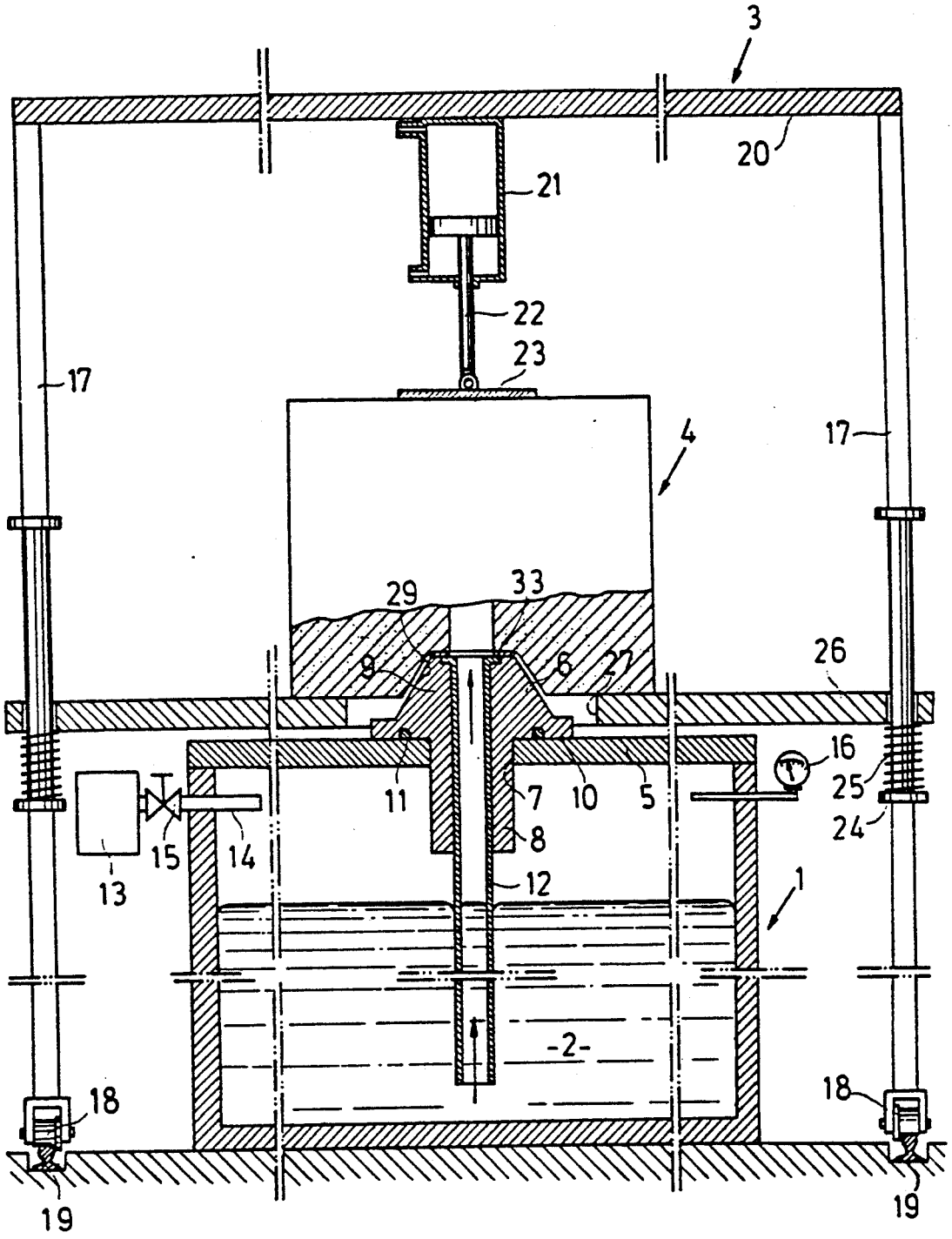
FIG. 1 is a vertical cross-section of a diagrammatic representation of a casting installation according to the invention.

The installation shown in FIG. 1 comprises a chamber 1 forming a cavity or reservoir for liquid metal 2, a mold-support frame 3, and a sand mold 4. This installation is used for the low-pressure casting of cast iron (gray cast iron or spherulitic graphite iron), steel, or a superalloy in the mold 4. Except for the internal configuration of the mold, the installation is identical to the one described in French Patent No. 2,295,808, cited above.

The stationary cavity 1 comprises an upper cover 5 attached in water-tight fashion to its lateral walls and locked in place using suitable means (not illustrated). A casting nozzle 6 passes through an orifice 7 in the cover 5. This nozzle 6 comprises a lower tubular part 8 whose external diameter matches the diameter of the orifice 7, and an upper part 9 having a generally tapered shape, whose large flat base 10 rests impermeably on the periphery of the orifice 7. A gasket 11 formed from an asbestos cord is housed in a recess in the base 10 of the nozzle. A feed tube or pipe 12 made of a heat-resistant material and immersed in the cast iron until it reaches the vicinity of the bottom of the cavity 1 passes through the nozzle; the upper part of the pipe 12 opens into the center of the nozzle 6, at the level of its flat upper surface.

The cavity 1 is connected to a pressurized gas source 13 by a pipe 14; the cavity is selectively connected to the pressure source or to the atmosphere by a suitable valve device 15 external to the cavity. A pressure gauge 16 makes it possible to monitor the pressure inside the cavity during casting.

The frame 3 comprises posts 17 fitted at their base with wheels 18 riding on two rails 19. The posts 17 are connected at their upper ends by a ceiling 20 supporting a jack 21 directed downwardly and whose piston rod 22 supports a support plate 23 joined to its lower end.

Each of the posts 17 is also fitted with a collar 24 on which a helical spring 25 rests. A horizontal base plate 26 may slide vertically along a portion of the posts 17 located above the collars 24. This plate 26 rests constantly for support on the upper ends of the springs 25 and is biased upwardly by them. When there is no downward pressure applied to the plate 26, it is positioned at a level above that of the upper surface of the nozzle 6. A circular opening 27 having a diameter large enough to allow the nozzle 6 to pass through it is cut in the plate 26.

Figure 2:
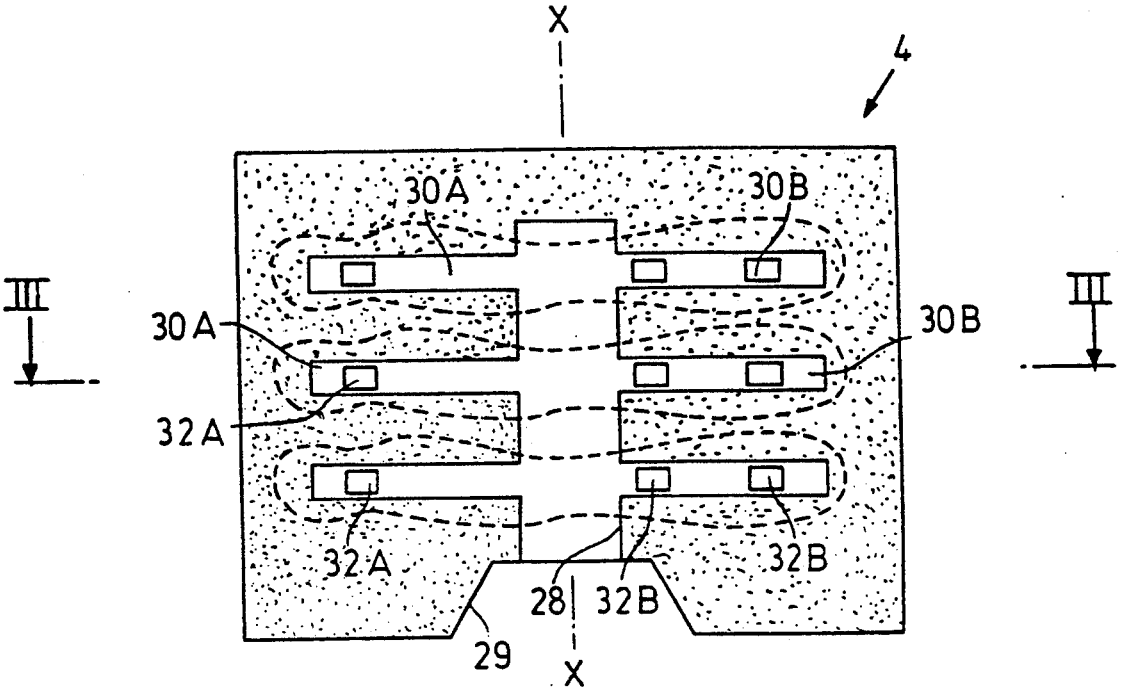
FIG. 2 illustrates a mold used in this installation, shown in cross-section along line II—II in FIG. 3.

The mold 4 is a solid multi-stage recessed mold, for example comprising three stages, as illustrated in FIG. 2. It comprises a vertical casting chamber 28 having a circular section approximately equal to that of the feed tube 12. This chamber is open at the base, which has a flared truncated recess 29 matching the shape of the nozzle 6. It extends up to a certain distance from the upper end surface of the mold.

Figure 3:
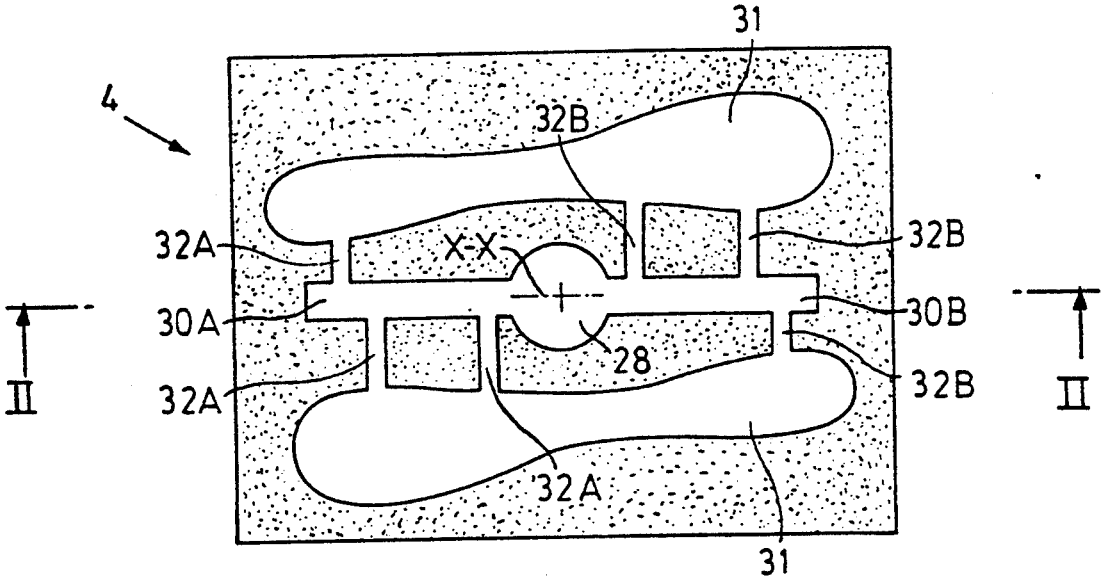
FIG. 3 is a cross-section view along line III—III in FIG. 2.

The three stages are identical, and the structure of each stage is shown in FIG. 3. Two ducts 30A and 30B extend horizontally from the casting chamber 28, each forming an extension of the other on opposite sides of the chamber 28. Each stage further comprises two identical elongated impressions 31. Each impression, extending on either side of the chamber, is fed by three ingates. In the example shown, for each impression there is one ingate 32A or 32B on one side of the chamber and two ingates 32B or 32A on the other side. The three ingates 32A connect the impressions to the duct 30A, and the three ingates 32B connect them to duct 30B. Thus, each duct 30A or 30B connects the casting chamber to all of the ingates located on the same side of the chamber 28 and is involved, therefore, in the feed of the two impressions belonging to that stage.

The ducts 30A and 30B have a relatively small cross-section. More specifically, the sum of the areas of the cross-sections of the intermediate ducts 30A, 30B belonging to a single stage is substantially less than the cross-sectional area of the casting chamber 28; e.g., it is less than 10% of this area. If the ducts have a variable cross-section along their lengths, for instance if they become larger downstream of their inlets, their inlet cross-sections fulfill this requirement. Furthermore, the sum of the cross-sectional areas of the ingates fed by a single duct is at least equal to the cross-sectional area of the duct, or that of its inlet.

The installation functions in the following way. Since the frame 3 is located at a distance from the cavity 1, a suitable heat-resistant water-tight joint 33 is installed on the bottom of the recess 29 of the mold 4. The mold 4, which contains a core (not shown) in each impression, is positioned on the plate 26 and centered over the opening 27. Next, the frame is moved on the rails 19 to a position above the cavity 1 containing the liquid cast iron, so that the nozzle 6 is positioned opposite the recess 29 of the mold. The jack 21 is then extended to lower, by means of the plate 23, the mold 4 and its support plate 26 against the force of the springs 25. This operation tightens the joint 33 between the bottom of the recess 29 and the nozzle, and ensures a water-tight connection of the casting chamber to the feed tube.

The cavity 1 is then connected to the pressure source 13 by the valve device 15. The pressure acting on the free surface of the cast iron causes it to rise in the tube 12. The cast iron fills the chamber 28 of the mold, the ducts 30A and 30B, and the impressions 31. The pressure is maintained for a predetermined period of time as a function of the dimensions and shapes of the parts to be produced. During this period, the chamber 28 acts as a reservoir or feeder, by supplying to the impressions the additional liquid cast iron needed to compensate for shrinkage. Next, the ingates and intermediate ducts solidify, the gas pressure is reduced to atmospheric pressure in the cavity 1 by the valve device 15, and the liquid cast iron in the chamber 28 and the tube 12 falls back into the cavity, draining these two passages.

The jack pressure is then released, the mold/support plate 26 assembly is pushed away from the nozzle 6 by the springs 25, and the entire frame 3 is moved horizontally away from the cavity on the rails 19.

Because of the aforementioned sizing of the ducts 30A, 30B and by providing a suitable gas flow through the duct 14, the liquid metal rises rapidly into the chamber 28, the necessary metallostatic pressure is established in the ducts belonging to each stage, and the two impressions in each stage are fed by the corresponding pair of ducts 30A and 30B. This makes it possible to simultaneously fill all of the impressions, no matter what their shape. Moreover, the relative narrowness or limited cross-section of the intermediate ducts limits the delivery rate of the metal flowing through them, thus leading, first, to better control, less turbulence, and greater capacity to accurately repeat the filling operation, and second, to minimal movement of the metal during each casting. These advantages are further promoted by the decreased pressure of the liquid metal when it enters the ingates, a result of the aforementioned sizing of the latter. The ultimate result is the improved integrity of the cast parts.

In one variant, the effect of the decreased pressure of the metal may be offset by increasing the cross-section of the intermediate ducts as they extend downstream.

It should further be noted that the use of intermediate ducts as obturators prevents any flow of appreciably cooled metal back into the cavity, without at the same time reducing the metal yield. This represents a substantial advantage as regards the capacity to reproduce the casting conditions. Furthermore, during the next casting operation, the slightly cooled metal contained in the casting chamber is distributed among all of the impressions of the mold.

I claim:

1. A method of low-pressure metal casting in a multi-stage sand mold, wherein said sand mold comprises, a plurality of stages, a vertical chamber traversing the plurality of stages, each of said plurality of stages including (i) at least one impression, (ii) at least one intermediate duct in liquid communication with said vertical chamber and extending horizontally outwardly from said vertical chamber, (iii) ingates extending between and in liquid communication with said at least one intermediate duct and said at least one impression, wherein the sum of the areas of the entry section of the intermediate ducts belonging to each stage is less than 10% of the area of the section of the vertical chamber;

said method comprising the step of introducing molten metal into the vertical chamber at an initial feed rate and at an initial feed pressure, (i) so that it passes from the chamber into the intermediate ducts, into the ingates, and into the impressions, and (ii) so that the feed rate of the molten metal as it passes from the vertical chamber into the intermediate ducts is less than the initial feed rate.

2. A method according to claim 1, further comprising the step of reducing the molten metal feed pressure downstream of the entrances to the intermediate ducts.

3. A method according to claim 2, further comprising the step of reducing the molten metal feed pressure at the entrances of the ingates.

4. A method according to claim 3, further comprising the step of establishing a sufficient molten metal flow rate in the vertical chamber to cause the molten metal to rise above all of the intermediate ducts.

5. A method according to claim 4, further comprising the steps of maintaining the molten metal pressure in the vertical chamber constant until the molten metal solidifies in the intermediate ducts, and thereafter reducing said pressure.

6. A multi-stage sand mold for low-pressure metal casting, comprising, a plurality of stages, a vertical chamber traversing all the stages, each of said plurality of stages including (i) at least one impression, (ii) at least one intermediate duct in liquid communication with said vertical chamber and extending horizontally outwardly from said vertical chamber, (ii) ingates extending between and in liquid communication with said at least one intermediate duct and said at least one impression, wherein the sum of the cross-sectional areas of the intermediate duct(s) associated with each stage is less than 10% of the cross-sectional area of the vertical chamber.

7. An apparatus according to claim 6, wherein the sum of the cross-sectional areas of the ingates supplied by an associated intermediate duct is at least equal to the cross-sectional area of said associated duct at the inlet thereof.

8. An apparatus according to claim 7, wherein each impression is fed by at least two intermediate ducts extending outwardly from opposite sides of the vertical chamber.

* * * * *